US005458374A

United States Patent [19]

Vijuk et al.

[11] Patent Number: 5,458,374

[45] Date of Patent: Oct. 17, 1995

[54] UNIVERSAL NON-JAMMING MULTI-PLY MULTI-FOLD OUTSERT WITH COMPACT PERIPHERAL EDGES (AND RELATED METHOD)

[76] Inventors: Robert Vijuk, 1061 Robey Ave., Downers Grove, Ill. 60516; Joseph M. Vijuk, 403 Royal Glen Ct., Oak Brook, Ill. 60521

[21] Appl. No.: 264,181

[22] Filed: Jun. 22, 1994

Related U.S. Application Data

[63] Continuation of Ser. No. 37,294, Mar. 26, 1993, abandoned.

[51] Int. Cl.[6] ..... B42D 15/04; B42D 15/00

[52] U.S. Cl. ..... 283/81; 283/61; 283/62; 281/2; 281/5; D20/22; 40/310; 428/40; 428/130

[58] Field of Search ..... 283/34, 81, 61, 283/62; 281/2, 5; D20/22, 23, 27, 28, 29; 40/539, 310; 428/40, 121, 130, 124.1

[56] References Cited

U.S. PATENT DOCUMENTS

| | | | |
|---|---|---|---|
| Re. 30,958 | 6/1982 | White | 40/310 |
| 1,853,829 | 4/1932 | Maury | 283/34 |
| 2,862,624 | 12/1958 | Stokes | 281/21.1 X |
| 4,010,299 | 3/1977 | Hershey, Jr. et al. | 40/310 X |
| 4,097,067 | 6/1978 | Schechter | 283/62 X |
| 4,583,763 | 4/1986 | Shacklett, Jr. | 281/2 X |
| 4,606,553 | 8/1986 | Nickerson | 281/5 |
| 4,616,815 | 10/1986 | Vijuk | 270/45 |
| 4,637,633 | 1/1987 | Instance | 283/81 |
| 4,812,195 | of/1989 | Vijuk | 156/357 |
| 4,817,931 | of/1989 | Vijuk | 270/18 |
| 4,905,977 | of/1990 | Vijuk | 270/45 |
| 4,906,024 | 3/1990 | Lein | 283/34 X |
| 5,044,873 | of/1991 | Vijuk | 414/792.5 |
| 5,046,710 | of/1991 | Vijuk | 270/37 |
| 5,156,898 | 10/1992 | McDonald | 428/130 X |
| 5,234,231 | 8/1993 | Hollander et al. | 281/2 |
| 5,351,991 | 10/1994 | McDonald | 281/5 X |

FOREIGN PATENT DOCUMENTS

| | | | |
|---|---|---|---|
| 744196 | 4/1933 | France | 281/5 |
| 1403865 | 5/1965 | France | 281/5 |
| 10939 | 9/1880 | Germany | 281/5 |
| 28013 | of 1907 | United Kingdom | 283/34 |
| 20385 | of 1914 | United Kingdom | 283/34 |

*Primary Examiner*—Frances Han

*Attorney, Agent, or Firm*—Marshall, O'Toole, Gerstein, Murray & Borun

[57] ABSTRACT

This invention relates to a universal, multi-ply, nonjamming package outsert having multiple folds, manufactured from an integral sheet of stock, the outsert having compact edges about its periphery, which are inserted into packages to provide printed information, instructions and warnings to the users of the product, for example, pharmaceutical or cosmetic products, and the like. A related method is also disclosed.

44 Claims, 8 Drawing Sheets

10
(PRIOR ART)

FIG. 2B(iii)

FIG. 2B(iv)

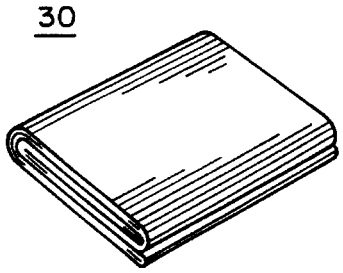
FIG. 3A
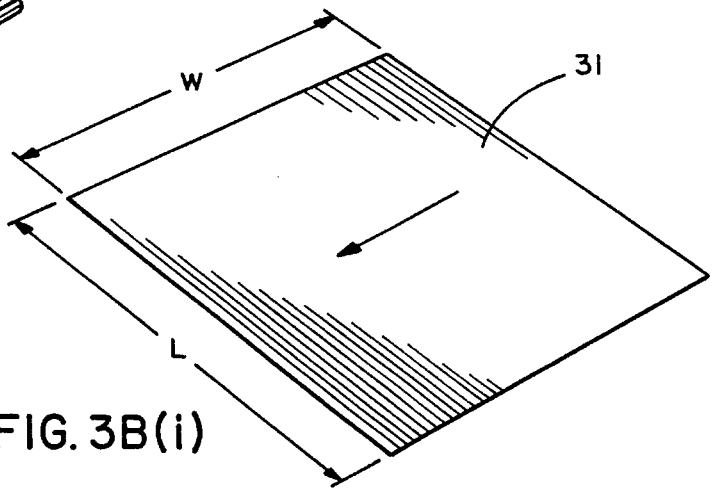
FIG. 3B(i)
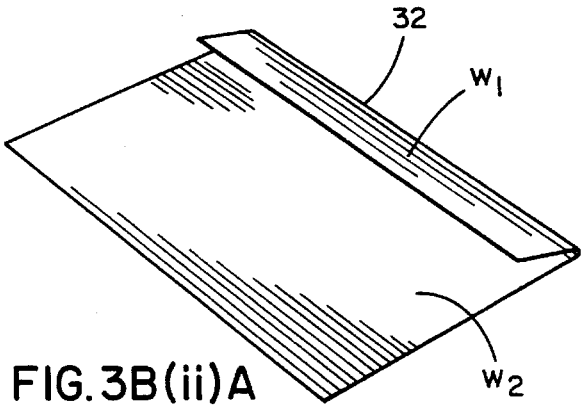
FIG. 3B(ii)A
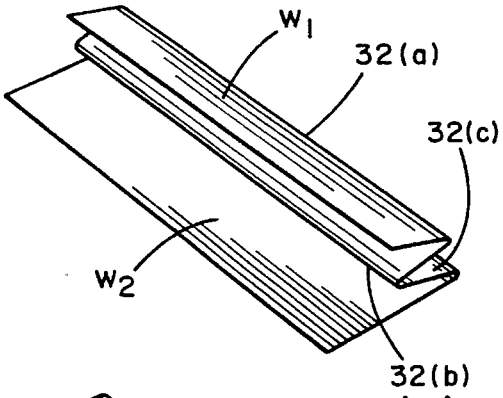
FIG. 3B(ii)C
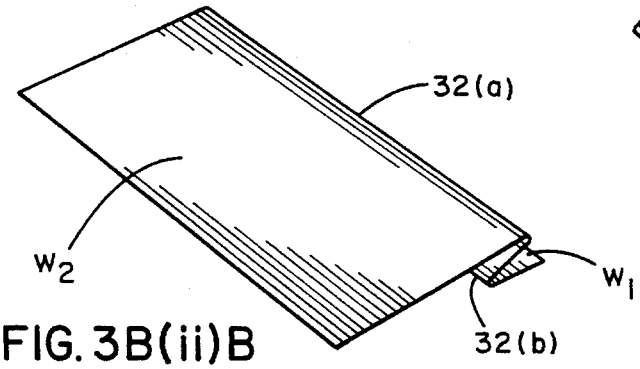
FIG. 3B(ii)B
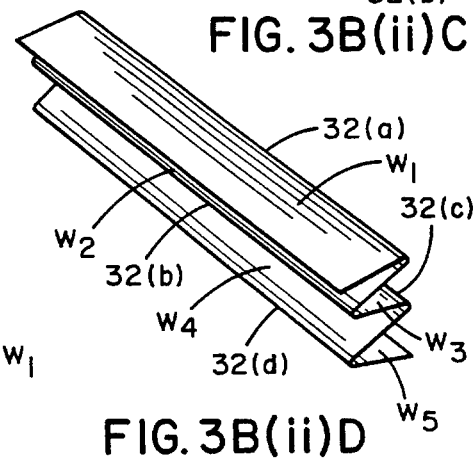
FIG. 3B(ii)D

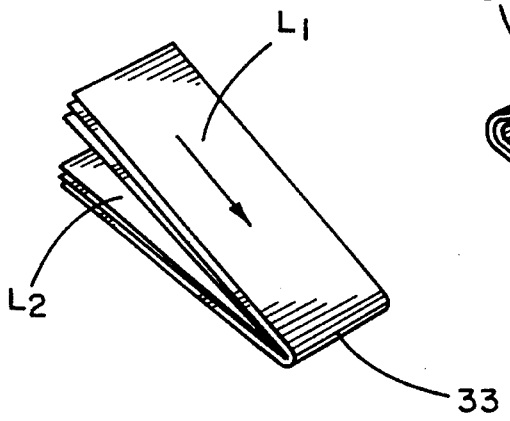
FIG. 3B(iii)
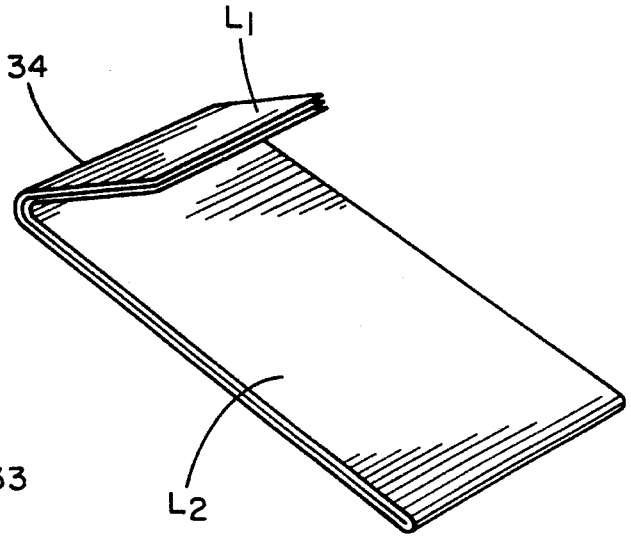
FIG. 3B(iv)
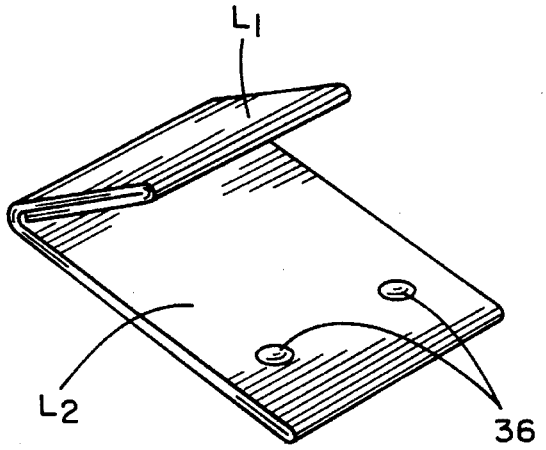
FIG. 3B(v)
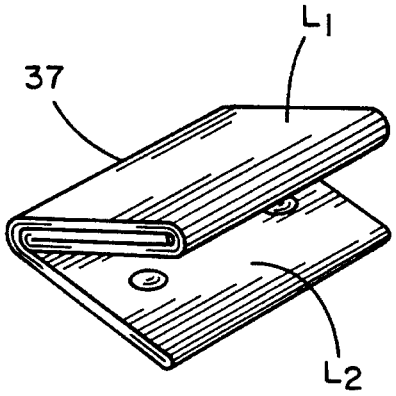
FIG. 3B(vi)

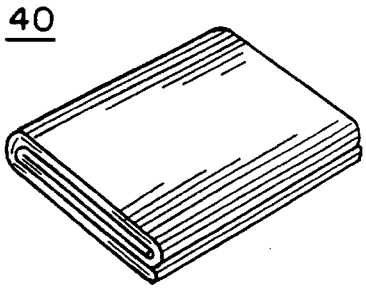
FIG. 4A
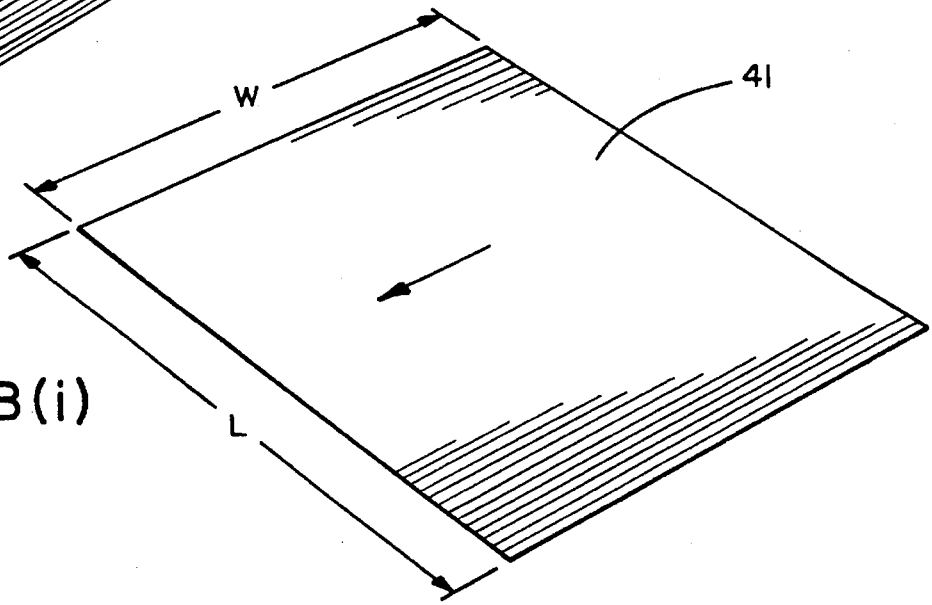
FIG. 4B(i)
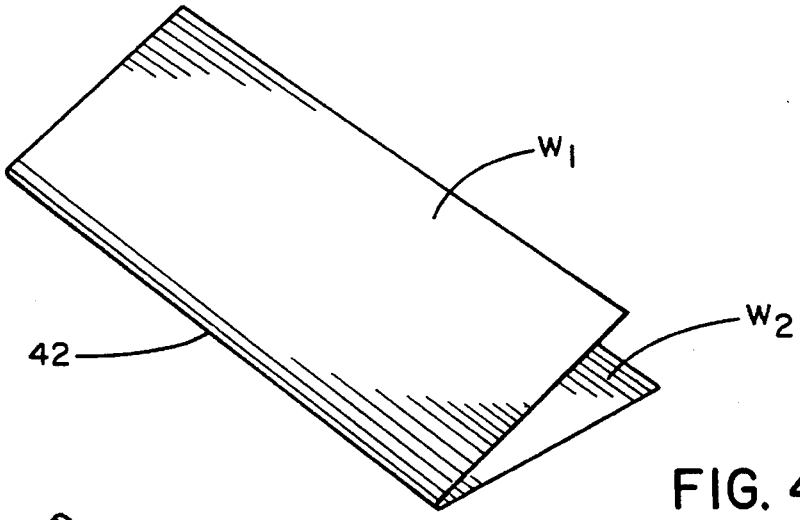
FIG. 4B(ii)
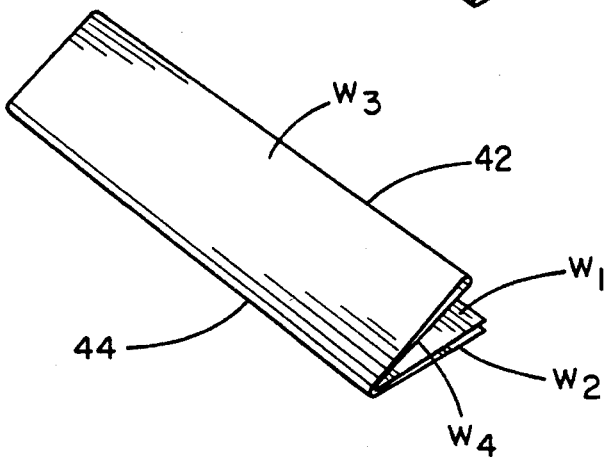
FIG. 4B(iii)

FIG. 4B (iv)
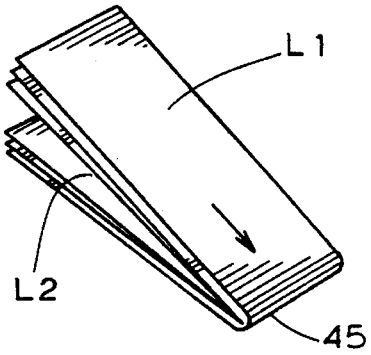
FIG. 4B (v)
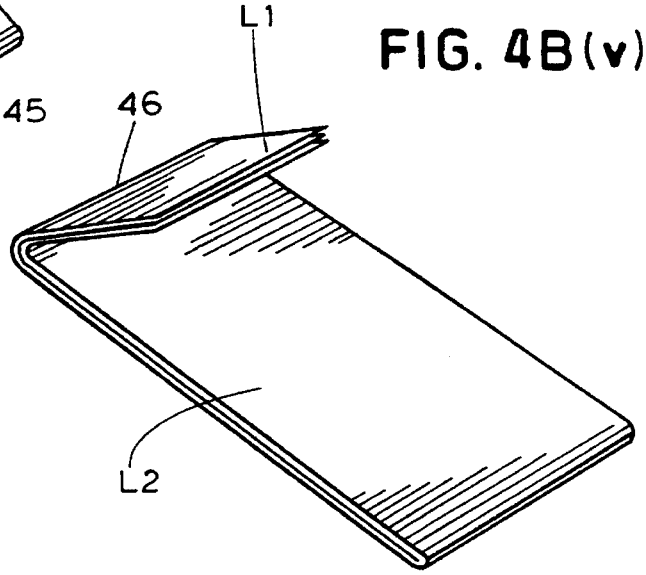
FIG. 4B (vi)
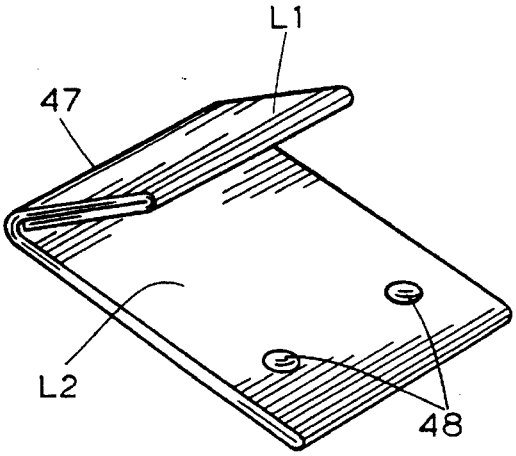
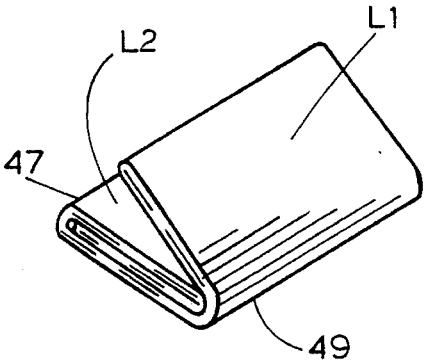
FIG. 4B (vii)

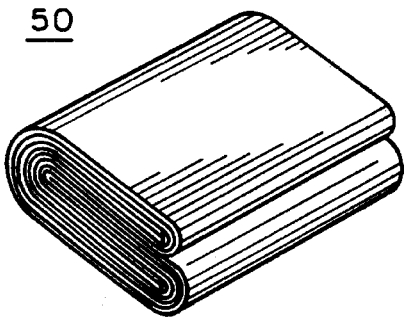
FIG. 5A
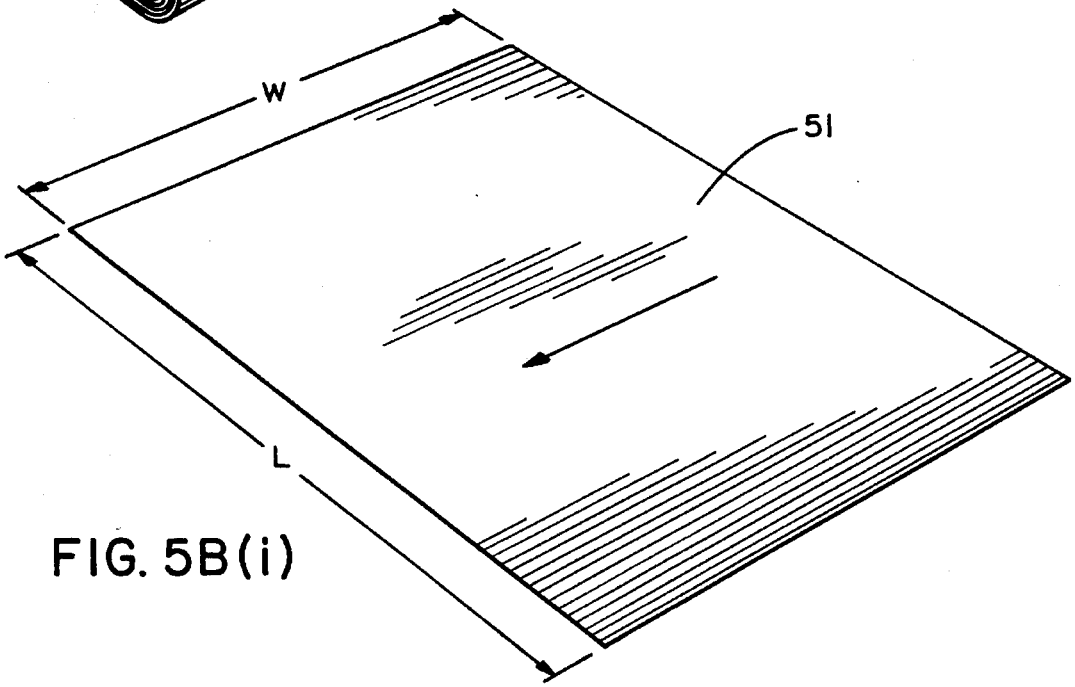
FIG. 5B(i)
FIG. 5B(ii)
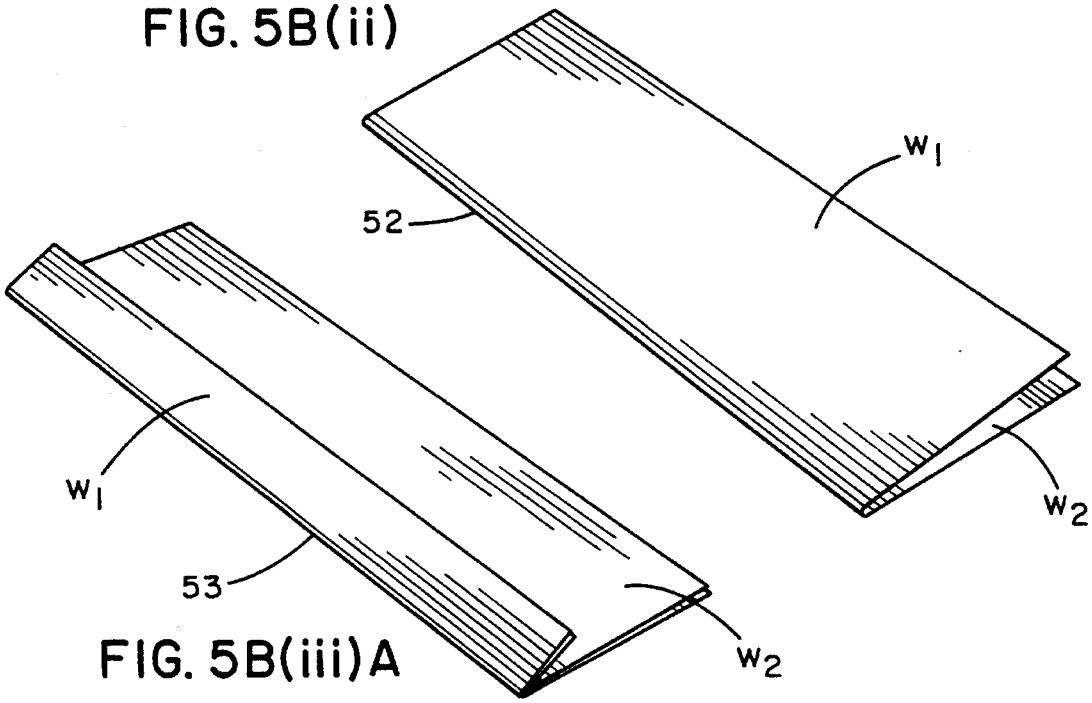
FIG. 5B(iii)A

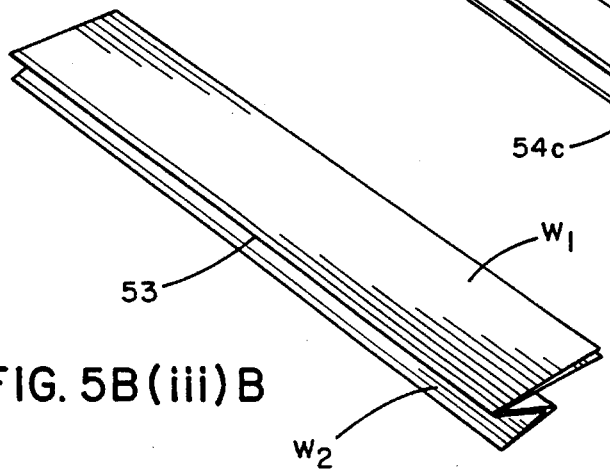
FIG. 5B(iii)B
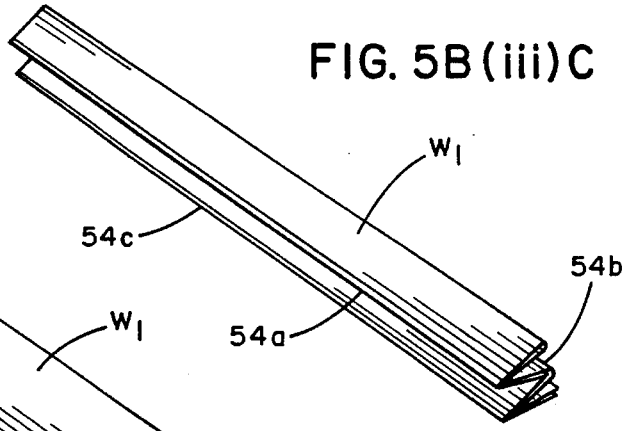
FIG. 5B(iii)C
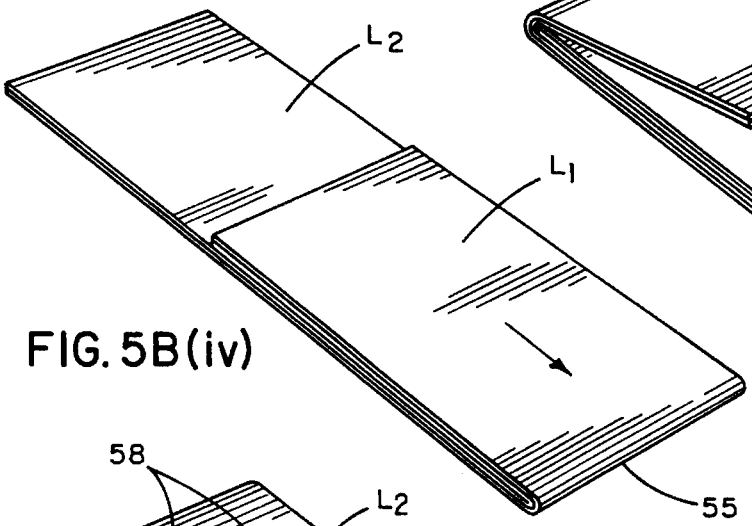
FIG. 5B(iv)
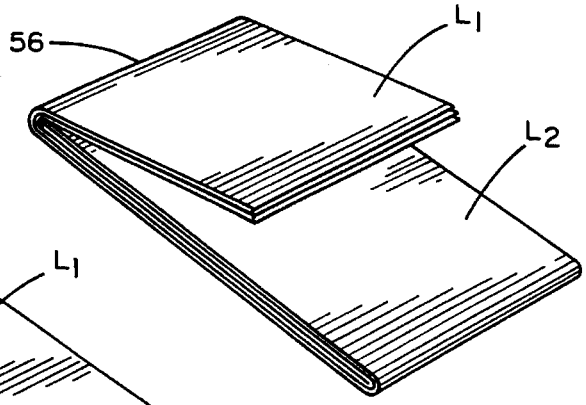
FIG. 5B(v)
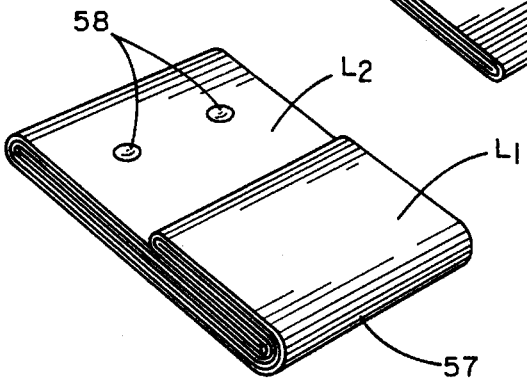
FIG. 5B(vi)
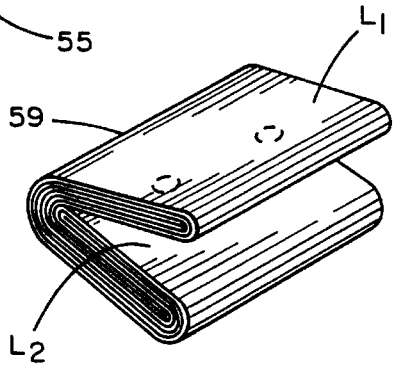
FIG. 5B(vii)

UNIVERSAL NON-JAMMING MULTI-PLY MULTI-FOLD OUTSERT WITH COMPACT PERIPHERAL EDGES (AND RELATED METHOD)

This is a continuation if application Ser. No. 08/037,294 filed on Mar. 26, 1993 now abandoned.

BACKGROUND OF THE INVENTION

This invention relates to a universal package outsert, and related method, and more particularly, to a universal, multiply, non-jamming, package outsert having multiple folds, which is manufactured from an integral sheet of stock, the outsert having compact edges about its periphery, which are inserted into (or otherwise applied to) packages to provide printed information, instructions and/or warnings to the users of the product, for example, for pharmaceutical products, and the like.

With respect to high-speed manufacturing of package outserts, a significant and important development is depicted in U.S. Pat. No. 4,812,195 issued Mar. 14, 1989 titled "Method And Apparatus For Making Outserts" (to VIJUK) where outserts are taught to be initially manufactured in multiples (say, of two, four, or six across) and then slit into individual outserts. This particular reference is a major advancement in the prior art with respect to increased speeds of operation of the associated machines and equipment used to manufacture folded outserts, as well as in the actual construction of the outsert itself, to facilitate high-speed manufacturing of the outsert. The completed outsert described in this patent is folded a number of times with the outermost fold of the outsert being glued tight to an inner fold to make a tight folded outsert having open edges about its periphery. Occasionally, open peripheral edges of an outsert may become problematic with respect to any manufacturing process, as the edges may get snagged or otherwise caught by the equipment used. The more folds an outsert contains, the thicker the outsert becomes, and the more problematic open edges of a completed outsert become. Accordingly, it would be advantageous to develop a universal multi-ply, multi-fold compact outsert that has compact edges about its periphery and which is manufactured without the need to trim the completed outsert to an acceptable size.

Esthetically, and practically, the copyspace of a multi-ply, multi-fold outsert is limited by the height of the outsert (i.e., limited to a maximum of about three inches high) and/or by the overall length of the outsert (i.e., limited to a maximum of about forty inches long). The size of the lettering used for the printed informational material has become an industry trend at legible type size (i.e., six point type size). This problem has caused outsert manufacturers to think about how to increase the amount of copyspace, given a requirement of legible type size, for an outsert without significantly increasing the size of the finished outsert. Along with this issue of maximizing copyspace for an outsert is the related problem associated with miniature folding of outserts (that is, as the number of multiple folds increases in the outsert, the harder it becomes to make the next additional fold, until some upper limit is reached in the absolute number of total folds that are possible for a given outsert, which cannot be overcome without a resulting increase in the overall size of the outsert). It would be advantageous to have a multi-ply, multi-fold outsert that will maximize the total number of folds that are possible to achieve within the smallest physical envelope that is available.

Originally, multi-ply, multi-fold outserts were placed within individual product cartons. Environmental considerations, as well as the need to reduce total packaging costs, has resulted in a new industry trend with respect to pharmaceutical, cosmetic, and similar products, with regard to the elimination of the usual retail cartons (which contain the retail product within) with the sale of the product at the retail outlet. It would be advantageous to have a universal, multi-ply, multi-fold outsert that is consistent with this new industry trend to eliminate individual retail product cartons and just shrink-wrap (or other suitable package application) the pharmaceutical product with the outsert positioned directly on the retail product (and then shrink-wrapped, or otherwise suitably applied), rather than in a separate carton. Further, it would be advantageous to have a universal, multi-ply, multi-fold outsert that may be used with or without separate product cartons.

Conventionally, multi-ply, multi-fold outserts may be sealed closed (i) by the use of glue spots at predetermined outsert locations or (ii) by the use of associated glue holes (that contain a suitable adhesive) at predetermined outsert locations. It would be advantageous to have a universal multi-ply, multi-fold outsert which either may be sealed closed (glued), or remain unglued, and nevertheless remain in a folded and compact relationship, nevertheless remain holding the outsert together when unglued.

The present invention is directed toward overcoming the various problems found in the prior art described above.

SUMMARY OF THE INVENTION

Accordingly, it is a primary object of the present invention to provide a universal, multi-ply, multi-fold outsert having compact edges about its entire periphery thereby eliminating the jamming of the outsert during fabrication.

Another object of the present invention is to provide a universal, multi-ply, multi-fold outsert having compact edges about its entire periphery and made from a single integral sheet and which will maximize the number of folds which are possible to achieve within the smallest three-dimensional physical envelope possible.

A further object of the present invention is to provide a universal, multi-ply, multi-fold outsert having compact edges about its entire periphery, and which is formed from a single integral sheet.

Another object of the present invention is to provide a universal multi-ply, multi-fold outsert which has a more compact three-dimensional physical envelope without the necessity of trimming the outsert and which is formed from a single integral sheet.

Other objects, advantages and features of the present invention will become apparent to those skilled in the art from a consideration of the following disclosure for the preferred embodiment, and accompanying specification, taken in conjunction with the drawings and appended claims.

Briefly, in practicing the preferred embodiment of the present invention there is provided a universal multi-ply, multi-fold outsert formed from a single integral sheet, the outsert having a predetermined length, width, height and pheriphery, the outsert having compact edges about the periphery, the outsert comprising in combination: a single sheet, the sheet traveling in a predetermined first direction, the sheet having a predetermined width and a predetermined length; a first fold across the entire length of the sheet, the first fold at a predetermined location on the sheet; a second fold, the second fold following the re-orientation of the sheet to a predetermined second direction, the second fold being a right-angle fold across the entire width of the sheet, the second fold at a predetermined location on the sheet and transverse to the plane of the first fold, the second fold resulting in the sheet having a first panel with a predetermined length and a second panel with a predetermined length, the second panel opposite the first panel, the panels having a first end and a second end opposite the first end, the first ends having open edges and the second ends having closed edges; on the panels of the sheet having an end with open edges, a right-angle fold across the entire width of the sheet at a predetermined location on the panels of the sheet; and on the panels of the sheet having an end with closed edges, a right angle fold across the width of the sheet at a predetermined location on the panels of the sheet, whereby, the outsert is completed with a right-angle fold, thereby making the outsert non-jamming during fabrication thereof.

In practicing a second embodiment of the present invention there is provided a universal multi-ply, multi-fold outsert formed from a single integral sheet, the outsert having a predetermined length, width, height and periphery, the outsert having compact edges about the periphery, the outsert comprising in combination: a single sheet, the sheet traveling in a predetermined first direction, the sheet having a predetermined width and a predetermined length; a first fold across the length of the sheet, the first fold having a plurality of tandem accordion folds, the first fold at a predetermined location on the sheet; a second fold, the second fold following the reorientation of the sheet to a predetermined second direction, the second fold being a right-angle fold across the width of the sheet, the second fold at a predetermined location at the sheet and transverse to the plane of the first fold, the second fold resulting in the sheet having a first panel with a predetermined length and a second panel with a predetermined length, the second panel opposite the first panel, the panels having a first end and a second end opposite the first end, the first ends having open edges and the second ends having closed edges; on the panels of the sheet having an end with open edges, a plurality of successive right-angle folds across the width of the sheet at predetermined locations on the panels; and on the panels of the sheet having an end with closed edges, a right angle fold across the width of the sheet at a predetermined location on the panel of the sheet, whereby, the outsert is completed with a right-angle fold thereby making the outsert non-jamming during fabrication thereof.

In practicing a third embodiment of the present invention there is provided a universal multi-ply, multi-fold outsert formed from a single integral sheet the outsert having a predetermined length, eidth, height and periphery, the outsert having compact edges about the periphery, the outsert comprising in combination: a single sheet, the sheet traveling in a predetermined first direction, the sheet having a predetermined entire width and a predetermined length; a first fold across the length of the sheet, the first fold at a predetermined location on the sheet; a second fold across the length of the sheet, the second fold at a predetermined location on the sheet; a third fold, the third fold following the re-orientation of the sheet to a predetermined second direction, the third fold being a right-angle fold across the width of the sheet, the third fold at a predetermined location at the sheet and transverse to the plane of the first fold, the third fold resulting in the sheet having a first panel with a predetermined length and a second panel with a predetermined length, the first panel length being less than the second panel length, the second panel opposite the first panel, the panels having a first end and a second end opposite the first end, the first ends having open edges and the second ends having closed edges; on the panels of the sheet having the shorter panel length, a plurality of successive right-angle folds across the width of the sheet at predetermined locations on the panels; and on the panels of the sheet having the longer panel length and having open edges at the first end, a right angle fold across the width of the sheet at a predetermined location on the panel of the sheet, the right angle fold being folded over the second end of the panels, whereby, the outsert is completed with a right-angle folds, thereby making the outsert non-jamming during fabrication thereof.

In practicing a fourth embodiment of the present invention there is provided a universal multi-ply, multi-fold outsert formed from a single integral sheet, the outsert having a predetermined length, width, height and periphery, the outsert having no open edges about its outsert comprising in combination: a single sheet, the sheet traveling in a predetermined first direction, the sheet having a predetermined width and a predetermined length; a first fold across the width of the sheet, the first fold at a predetermined location on the sheet; a second fold across the width of the sheet, the second fold having a plurality of tandem accordion folds, the second fold at a predetermined location on the sheet; a third fold, the third fold following the re-orientation of the sheet to a predetermined second direction, the third fold being a right-angle fold across the length of the sheet, the third fold at a predetermined location at the sheet and transverse to the plane of the first fold, the third fold resulting in the sheet having a first panel with a predetermined length and a second panel with a predetermined length, the first panel length being less than the second panel length, the second panel opposite the first panel, the panels having a first end and a second end opposite the first end, the first ends having open edges and the second ends having closed edges; on the panels of the sheet having the shorter panel length, a plurality of successive right-angle folds across the length of the sheet at predetermined locations on the panels; on the panels of the sheet having the longer panel length and having open edges at the first end, a right angle fold across the length of the sheet at a predetermined location on the panel of the sheet, the right angle fold being folded over the second end of the panels; and adhesive at a predetermined location on the sheet, the adhesive joining the first panel to the second panel in a predetermined relationship, whereby, the outsert is completed with a right-angle fold, thereby making the outsert non-jamming during fabrication thereof.

BRIEF DESCRIPTION OF THE DRAWINGS

FIG. 3A is a perspective view of a universal, non-jamming, multi-ply outsert having multiple folds, which is manufactured from an integral sheet of stock, the outsert having compact edges about its periphery, that is constructed in accordance with the present invention.

FIG. 3B is a detailed step-by-step diagrammatic view of the outsert depicted in FIG. 3A that is constructed in accordance with the present invention.

FIG. 4A is a perspective view of a universal, non-jamming, multi-ply outsert having multiple folds, which is manufactured from an integral sheet of stock, the outsert having compact edges about its periphery, that is constructed in accordance with the present invention.

FIG. 4B is a detailed step-by-step diagrammatic view of the outsert depicted in FIG. 4A that is constructed in accordance with the present invention.

FIG. 5A is a perspective view of a universal, non-jamming, multi-ply outsert having multiple folds, which is manufactured from an integral sheet of stock, the outsert having compact edges about its periphery, that is constructed in accordance with the present invention.

FIG. 5B is a detailed step-by-step diagrammatic view of the outsert depicted in FIG. 5A that is constructed in accordance with the present invention.

FIG. 6 is a perspective view of an outsert that is constructed in accordance with the present invention suitably applied to the outside of a container for a pharmaceutical product, and the like.

DETAILED DESCRIPTION OF THE INVENTION

Figure 1:
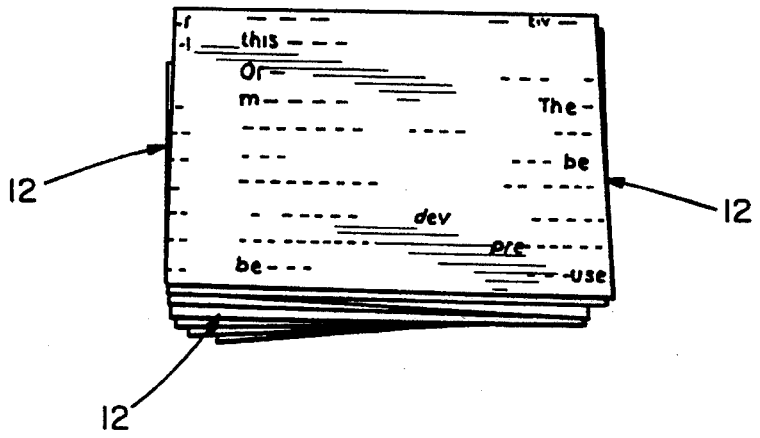
FIG. 1 of the drawings illustrates an example of an informational package outsert having open edges about its periphery that is constructed in accordance with the prior art.

The present invention can be better understood by reference to the accompanying drawings taken in conjunction with the following discussion. FIG. 1 illustrates an example of an informational package outsert 10 having open edges 12 about its periphery that is constructed in accordance with the prior art. As mentioned previously, under certain circumstances the open peripheral edges 12 of the outsert will tend to cause bottlenecks, or other manufacturing yield problems, with respect the overall high-speed manufacturing environment that is associated with manufacturing the outsert, or with respect to the specific in-line packaging equipment that is utilized.

Figure 2A:
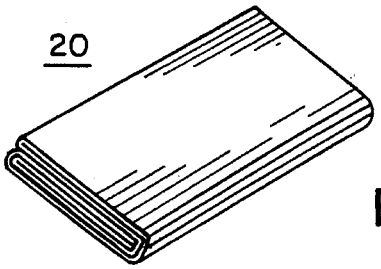
FIG. 2A is a perspective view of a universal, non-jamming, multi-ply outsert having multiple folds, which is manufactured from an integral sheet of stock, the outsert having compact edges about its periphery, that is constructed in accordance with the present invention.
Figure 2B:
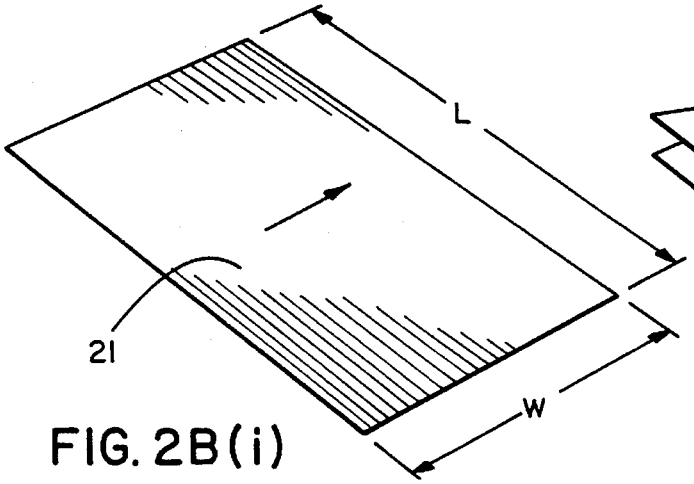
FIG. 2B is a detailed step-by-step diagrammatic view of the outsert depicted in FIG. 2A that is constructed in accordance with the present invention.
Figure 2B:
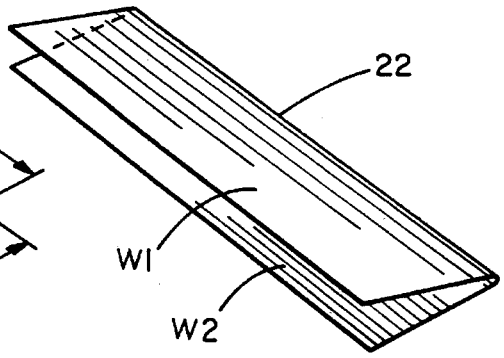
Figure 2B:
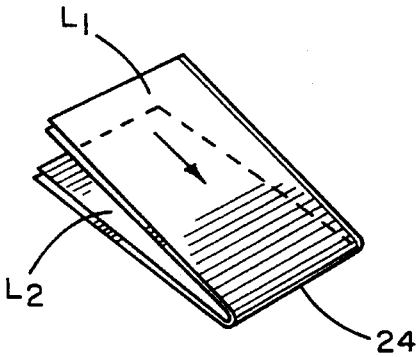
Figure 2B:
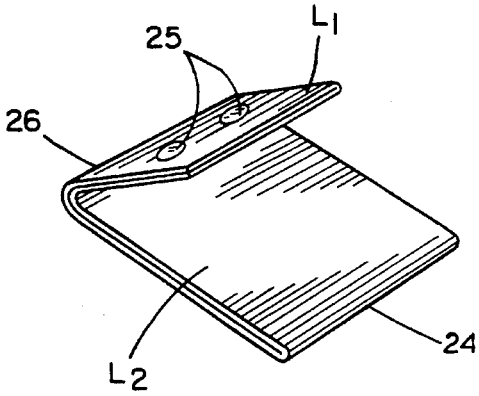
Figure 2B:
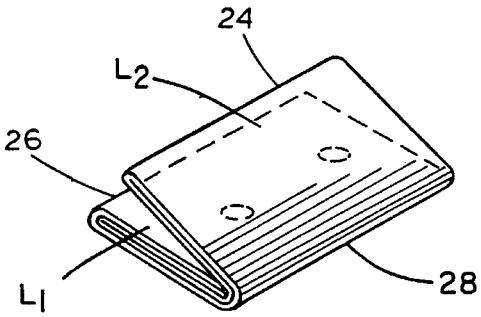

FIG. 2A is a perspective view of a universal, non-jamming, multi-ply outsert 20 having multiple folds, which is manufactured from an integral sheet of stock, the outsert having compact edges about its periphery. FIG. 2B is a detailed step-by-step diagrammatic view of the outsert 20 that is depicted in FIG. 2A. Referring to FIGS. 2A and 2B, starting with web stock that is directly fed to an in-line cutter, where the stock is cut into separate individual sheets (or, alternatively, starting with individual sheet stock which is automatically stacked and fed). The size of the individual sheet stock is a variable. For example, it has been demonstrated that starting with a commercial grade sheet stock having an overall length (L) of approximately 8.375 inches, and an overall width (W) of approximately 4.125 inches, an improved outsert can be manufactured containing a total minimum of four multiple folds (i.e., approximately twelve total ply thickness and which will have an overall size of approximately 2.438 inches wide, approximately 1.5 inches high, and approximately 0.125 inches thick (depending on the original thickness of the individual sheet stock used).

To manufacture the improved outsert depicted in FIG. 2A, starting at FIG. 2B(i), and with the individual sheet stock 21 traveling in a predetermined first direction, an initial fold 22 is made across the entire length of the sheet stock and is at a right angle from the point of origin. [see FIG. 2B(ii) ] This initial fold may be an even fold or an uneven fold (i.e., may be folded over to less than all of the adjoining section of sheet stock). This initial fold results in the sheet stock having a top panel (W1) and an adjoining bottom panel (W2).

If the initial fold is an even fold, the resulting width will be ½ of the initial width (i.e., W1=W2=½ W). Following completion of this initial fold, the sheet stock will have an overall thickness of two plies.

At FIG. 2B(iii), and following the re-orientation of the individual sheet stock 21 to a different predetermined second direction (i.e., re-oriented substantially 90 degrees from the first direction), the second fold 24 is then made across the entire width of the sheet stock at a designated location and is at a right angle from the point of origin. This second fold may be an even fold or an uneven fold (i.e., may be folded over to less than all of the adjoining section of the sheet stock). This second fold will result in the sheet stock having a top panel length (L1) and an adjoining bottom panel length (L2).

If the second fold is an even fold, the resulting length will be ½ of the initial length (i.e., L1=L2=½ L). Following completion of this second fold, the sheet stock will have an overall thickness of four plies. Also, after completion of this second fold, the resulting folded sheet stock will have two ends of orientation, one end being a folded closed-end, and the other end being an open-edge end, not having any fold.

At FIG. 2B(iv), the third fold 26 is made across the entire width of the sheet stock at a right angle from the point of origin, the third fold being located at the open-edge end of the folded sheet stock. This third fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this third fold, the sheet stock will have an overall thickness of eight plies for the resulting top panel length, and four plies for the resulting bottom panel length.

Following the third fold [see FIG. 2B(iv)], at a designated location on the resulting top panel length, a single glue spot 25 (or glue spots) is made thereon, with a suitable adhesive.

At FIG. 2B(v), the fourth fold 28 is made to complete the improved outsert. The fourth fold is made across the entire width of the sheet stock at a right angle from the point of origin, the fourth fold being located at the closed-end of the folded sheet stock. This fourth fold is equal to approximately ½ of the total panel length and will result in the sheet stock now having a resulting top panel length (L1) and a resulting adjoining bottom panel length (L2) (i.e., L1=½ L and L2=½ L). This fourth fold is made in a manner whereby the adhesive will maintain the improved outsert in a more or less fixed and compact relationship with respect to the top and bottom panel lengths of the folded sheet stock. Following completion of this final fold, the improved outsert will have an overall thickness of approximately twelve plies If desired, the gluing step may be omitted, as the improved outsert finishes with a right-angle fold, which thereby eliminates all open edges about the periphery of the improved outsert which has a more three-dimensional physical envelope.

Additionally, in as much as the improved outsert depicted in FIG. 2B is manufactured from a single sheet of stock, the improved outsert does not require any trimming step to be performed to achieve a certain size. The final size of the improved outsert is achieved by selecting the correct respective size of initial sheet stock to be utilized.

FIG. 3A is a perspective view of a universal, nonjamming, multi-ply outsert 30 having multiple folds, which is manufactured from an integral sheet of stock, the outsert having compact edges about its periphery. FIG. 3B is a detailed step-by-step diagrammatic view of the outsert 30 that is depicted in FIG. 3A. Referring to FIGS. 3A and 3B, starting with web stock that is fed to an in-line cutter, where the stock is cut into separate individual sheets (or, alternatively, starting with individual sheet stock which is automatically stacked and fed).

The size of the individual sheet stock is a variable. For example, it has been demonstrated that starting with a commercial grade sheet stock having an overall length (L) of approximately 12.0 inches, and an overall width (W) of approximately 11.0 inches, an improved outsert can be manufactured containing a total of eight multiple folds (i.e., approximately forty total ply thickness and which will have an overall size of approximately 2.25 inches wide, approximately 1.5 inches high, and approximately 0.3125 inches thick (depending on the original thickness of the individual sheet stock used).

To manufacture the improved outsert depicted in FIG. 3A, starting at FIG. 3B(i), and with the individual sheet stock 31 traveling in a predetermined first direction, an initial fold 32, which consists of a number of substantially parallel folds (consisting of a series of tandem folds [32(*a*), 32(*b*), 32(*c*) and 32(*d*)] comprising a four-fold accordion fold), is made across the entire length of the sheet stock and is at a right angle from the point of origin. [see FIG. 3B(ii) ] This initial fold 32 may be an even fold or an uneven fold (i.e., may be folded over to less than all of the adjoining section of sheet stock).

If the initial fold 32 is an even fold, the resulting width will be ⅕ of the initial entire width (i.e., W1=W2=W3=W4=W5=⅕ W). This initial fold is a four-fold tandem accordion fold, and assuming the initial fold has equal panels, each panel will consist of the four-fold tandem accordion fold that is equal to ⅕ the original entire width (i.e., W1=⅕ W). This initial fold results in the sheet stock having a tandem series of substantially equally-sized adjoining panels, with accordion folds (running length-wise) being positioned between adjacent panels. Following completion of this initial fold, the sheet stock will have an overall thickness of five plies.

At FIG. 3B(iii), and following the re-orientation of the individual sheet stock 31 to a different predetermined second direction (i.e., re-oriented substantially 90 degrees from the first direction), a second fold 33 is then made across the entire width of the sheet stock at a designated location and is at a right angle from the point of origin. This second fold may be an even fold or an uneven fold (i.e., may be folded over to less than all of the adjoining section of the sheet stock). This second fold will result in the sheet stock having a top panel length (L1) and an adjoining bottom panel length (L2).

If the second fold is an even fold, the resulting length will be ½ of the initial length (i.e., L1=L2=½ L. Following completion of this second fold, the sheet stock will have an overall thickness of ten plies. Also, after completion of this second fold, the resulting folded sheet stock will have two ends of orientation, one end being a folded closed-end, and the other end being an open-edge end, not having any fold.

At FIG. 3B(iv), the third fold 34 is made across the entire width of the sheet stock at a right angle from the point of origin, the third fold being located at the open-edge end of the folded sheet stock. This third fold is equal to approximately ¼ of the total panel length and will result in the sheet stock now having a resulting top panel length (L1) and an resulting adjoining bottom panel length (L2) (i.e., L1=¼ L and L2=¾ L). Following completion of this third fold, the sheet stock will have an overall thickness of twenty plies for the resulting top panel length, and ten plies for the resulting bottom panel length.

At FIG. 3B(v), the fourth fold 35 is made across the entire width of the sheet stock at a right angle from the point of origin, the fourth fold being located at the section of folded sheet stock that is adjacent to the open-edge end portion of the folded sheet stock. This fourth fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this fourth fold, the sheet stock will have an overall thickness of thirty plies for the resulting top panel length, and ten plies for the resulting bottom panel length.

At FIG. 3B(v), following the fourth fold, at a designated location on the resulting bottom panel length, a single glue spot 36 (or glue spots) is made thereon, with a suitable adhesive.

At FIG. 3(B)(vi), the fifth fold 37 is made to complete the improved outsert. The fifth fold is made across the entire width of the sheet stock at a right angle from the point of origin, the fifth fold being located at the section of folded sheet stock that is next to the adjacent section previously discussed (i.e., the adjacent section being next to the open-edge end portion of the folded sheet stock). This fifth fold is equal to approximately ½ of the total panel length and will result in the sheet stock now having a resulting top panel length (L1) and a resulting adjoining bottom panel length (L2) (i.e., L1=½ L and L2=½ L). This fifth fold is made in a manner whereby the adhesive will maintain the improved outsert in a more or less fixed and relationship with respect to the top and bottom panel lengths of the folded sheet stock. Following completion of this final fold, the improved outsert will have an overall thickness of approximately forty plies.

If desired, the gluing step may be omitted, as the improved outsert finishes with a right-angle fold, which thereby eliminates all open edges about the periphery of the improved outsert which has a more three-dimensional physical envelope.

Additionally, in as much as the improved outsert depicted in FIG. 3B is manufactured from a single sheet of stock, the improved outsert does not require any trimming step to be performed to achieve a certain size. The final size of the improved outsert is achieved by selecting the correct respective size of initial sheet stock to be utilized.

FIG. 4A is a perspective view of a universal, nonjamming, multi-ply outsert 40 having multiple folds, which is manufactured from an integral sheet of stock, the outsert having compact edges about its periphery. FIG. 4B is a detailed step-by-step diagrammatic view of the outsert 40 that is depicted in FIG. 4A. Referring to FIGS. 4A and 4B, starting with web stock that is fed to an in-line cutter, where the stock is cut into separate individual sheets (or, alternatively, starting with individual sheet stock which is automatically stacked and fed).

The size of the individual sheet stock is a variable. For example, it has been demonstrated that starting with a commercial grade sheet stock having an overall length (L) of approximately 9.875 inches, and an overall width (W) of approximately 8.0 inches, an improved outsert can be manufactured containing a total of ten multiple folds (i.e., approximately thirty-five total ply thickness) and which will have an overall size of approximately 2.0 inches wide, approximately 1.1875 inches high, and approximately 0.125 inches thick (depending on the original thickness of the individual sheet stock used).

To manufacture the improved outsert depicted in FIG. 4A, starting at FIG. 4B(i), and with the individual sheet stock 41 traveling in a predetermined first direction, an initial fold 42 is made across the length of the sheet stock and is at a right angle from the point of origin [see FIG. 4B(ii)]. This initial fold may be an even fold or an uneven fold (i.e., may be folded over to less than all of the adjoining section of sheet stock). This initial fold results in the sheet stock having a top panel (W1) and an adjoining bottom panel (W2).

If the initial fold is an even fold, the resulting width will be ½ of the initial width (i.e., W1=W2=½ W). Following completion of this initial fold, the sheet stock will have an overall thickness of two plies.

At FIG. 4B(iii), the second fold 44, is made across the entire length of the sheet stock and is at a right angle from the point of origin. This second fold may be an even fold or an uneven fold (i.e., may be folded over to less than all of the adjoining section of sheet stock).

If the second fold is an even fold, the resulting width will be ¼ of the initial entire width (i.e., W1=W2=W3=W4=¼ W). This second fold results in the sheet stock having a tandem series of substantially equally-sized adjoining panels, with folds 44 running length-wise being positioned between adjacent panels. Assuming this second fold has four equal panels, each panel will consist of the three-fold tandem fold that is equal to ¼ the original entire width (i.e., W1=¼ W). Following completion of this second fold, the sheet stock will have an overall thickness of four plies.

At FIG. 4B(iv), and following the re-orientation of the individual sheet stock 41 to a different predetermined second direction (i.e., re-oriented substantially 90 degrees from the first direction), the third fold 45 is then made across the entire width of the sheet stock at a designated location and is at a right angle from the point of origin. This third fold may be an even fold or an uneven fold (i.e., may be folded over to less than all of the adjoining section of the sheet stock). This third fold will result in the sheet stock having a top panel length (L1) and an adjoining bottom panel length (L2).

If this third fold is an uneven fold (i.e., a short fold), this third fold will result in the sheet stock having a top panel length (L1) having open edges and an adjoining bottom panel length (L2) having closed edges. For example the third fold will create a top panel (L1) having open edges [not depicted in FIG. 4B(iv), but previously illustrated in FIG. 4B(iii)] open edges that is equal to ⅜ of the length of the resulting bottom panel (L1=⅜ L) and an adjoining bottom panel (L2) having open edges [not depicted in FIG. 4B iv), but previously illustrated in FIG. 4B (iii)] (L2=⅝ L). Following completion of this third fold, the sheet stock will have an overall thickness of eight plies. Also, after completion of this third fold, the resulting folded sheet stock will have two ends of orientation, one end longer than the other end, and each end having open edges.

If the third fold is an even fold, the resulting length will be ½ of the initial length (i.e., L1=L2=½ L). After completion of this third fold, the resulting folded sheet stock will have two ends of orientation, one end being a folded closed-end, and the other end being an open-edge end, not having any fold.

At FIG. 4B(v), the fourth fold 46 is made across the entire width of the sheet stock at a designated location and is at a right angle from the point of origin. This fourth fold is an uneven fold (i.e., a short fold) and is located at the longer bottom panel end having open-edge end of the folded sheet stock. This fourth fold will result in the sheet stock having a top panel length (L1) having open edges and an adjoining bottom panel length (L2) having open edges. The fourth fold will create a top panel (L1) having open edges that is equal to ⅖ of the length of the resulting bottom panel (L2) (L1=⅖ L) and an adjoining bottom panel having open edges (L2=⅗ L). Following completion of this fourth fold, the sheet stock will have an overall thickness of sixteen plies. Also, after completion of this fourth fold, the resulting folded sheet stock will have two ends of orientation, one end longer than the other end, and each end having open edges.

At FIG. 4B(vi), the fifth fold 47 is made across the entire width of the sheet stock at a right angle from the point of origin, the fifth fold being located at the section of folded sheet stock that is adjacent to the open-edge end portion of the folded sheet stock. This fifth fold is equal to approximately ⅓ of the total panel length and will result in the sheet stock now having a resulting top panel length (L1) and a resulting adjoining bottom panel length (L2) (i.e., L1=⅓ L and L2=⅔ L). Each of the resulting adjoining bottom and top panels will have closed ends (i.e., edges). Following completion of this fifth fold, the outsert will have an overall thickness of twenty plies.

At FIG. 4B(vi), following the fifth fold, at a designated location on the resulting bottom panel length, a single glue spot 48 (or glue spots) is made thereon, with a suitable adhesive.

At FIG. 4B (vii), the sixth fold 49 is made to complete the improved outsert. The sixth fold is made across the entire width of the sheet stock at a right angle from the point of origin. This sixth fold is equal to approximately ½ of the total panel length and will result in the sheet stock now having a resulting top panel length (L1) and a resulting adjoining bottom panel length (L2) (i.e., L1=½ L and L2=½ L). This sixth fold is made and folded over the second end of the resulting panel length and is made in a manner whereby the adhesive will maintain the improved outsert in a more or less fixed and compact relationship with respect to the top and bottom panel lengths of the folded sheet stock. Following completion of this final fold, the improved outsert will have an overall thickness of approximately thirty-six plies.

If desired, the gluing step may be omitted, as the improved outsert finishes with a right-angle fold, which thereby eliminates all open edges about the periphery of the improved outsert which has a more three-dimensional physical envelope.

Additionally, in as much as the improved outsert depicted in FIG. 4B is manufactured from a single sheet of stock, the improved outsert does not require any trimming step to be performed to achieve a certain size. The final size of the improved outsert is achieved by selecting the correct respective size of initial sheet stock to be utilized.

FIG. 5A is a perspective view of a universal, non-jamming, multi-ply outsert 50 having multiple folds, which is manufactured from an integral sheet of stock, the outsert having compact edges about its periphery. FIG. 5B is a detailed step-by-step diagrammatic view of the outsert 50 that is depicted in FIG. 5A. Referring to FIGS. 5A and 5B, starting with web stock that is fed to an in-line cutter, where the stock is cut into separate individual sheets (or, alternatively, starting with individual sheet stock which is automatically stacked and fed).

The size of the individual sheet stock is a variable. For example, it has been demonstrated that starting with a commercial grade sheet stock having an overall length (L) of approximately 18.0 inches, and an overall width (W) of approximately 12.0 inches, an improved outsert can be manufactured containing a total of eight multiple folds (i.e., approximately sixty-four total ply thickness) and which will have an overall size of approximately 2.25 inches wide, approximately 1.5 inches high, and approximately 0.25 inches thick (depending on the original thickness of the individual sheet stock used).

To manufacture the improved outsert depicted in FIG. 5A, starting at FIG. 5B(i), and with the individual sheet stock 51 traveling in a predetermined first direction, an initial fold 52 is made across the length of the sheet stock and is at a right angle from the point of origin [see FIG. 5B (ii)]. This initial fold may be an even fold or an uneven fold (i.e., may be folded over to less than all of the adjoining section of sheet stock). This initial fold results in the sheet stock having a top section (W1) and an adjoining bottom section (W2).

If the initial fold is an even fold, the resulting width will be ½ of the initial width (i.e., W1=W2=½ W). Following completion of this initial fold, the sheet stock will have an overall thickness of two plies.

At FIG. 5B(iii), the second fold 53, which consists of a number of substantially parallel folds [consisting of a series of tandem folds comprising a three-fold accordion fold 54(*a*), 54(*b*) and 54(*c*), is made across the entire length of the sheet stock and is at a right angle from the point of origin. This second fold may be an even fold or an uneven fold (i.e., may be folded over to less than all of the adjoining section of sheet stock).

If the second fold is an even fold, the resulting entire width will be ¼ of the initial width (i.e., W1=W2=W3=W4=¼ W). This second fold is a three-fold tandem accordion fold, and assuming the second fold has four equal panels, each panel will consist of the three-fold tandem accordion fold that is equal to ¼ the original entire width (i.e., W1=¼ W). This second fold results in the sheet stock having a tandem series of substantially equally-sized adjoining panels, with accordion folds (running length-wise) being positioned between adjacent panels. Following completion of this initial fold, the sheet stock will have an overall thickness of eight plies.

At FIG. 5B(iv), and following the re-orientation of the individual sheet stock 51 to a different predetermined second direction (i.e., re-oriented substantially 90 degrees from the first direction), the third fold 55 is then made across the entire width of the sheet stock at a designated location and is at a right angle from the point of origin. This third fold is an uneven fold (i.e., a short fold); this third fold will result in the sheet stock having a top panel length (L1) having open edges and an adjoining bottom panel length (L2) having no open edges (but having one end with open edges). The third fold will create a top panel having open edges that is equal to ⅜ of the initial length (L1=⅜ L) and an adjoining bottom panel (L2=⅝ L). Following completion of this third fold, the outsert will have an overall thickness of sixteen plies. Also, after completion of this third fold, the resulting folded sheet stock will have two ends of orientation, one end longer than the other end.

At FIG. 5B(v), the fourth fold 56 is made across the entire width of the sheet stock at a designated location and is at a right angle from the point of origin at a location on the short panel lengths. This fourth fold is an uneven fold (i.e., a short fold) and is located at the shorter top panel end having open-edges end of the folded sheet stock. This fourth fold will result in the sheet stock having a top panel length (L1) having no open peripheral edges and an adjoining bottom panel length (L2) having no open peripheral edge. The fourth fold will create a top panel that is equal to ⅖ of the initial length (L1=⅖ L) and an adjoining bottom panel that is equal to ⅗ of the initial length (L2=⅗ L). Following completion of this fourth fold, the outsert will have an overall thickness of twenty-four plies (and sixteen plies at the other portion of the outsert).Also, after completion of this fourth fold, the resulting folded sheet stock will have two ends of orientation, each end having edges.

At FIG. 5B(vi), the fifth fold 57 is made across the entire width of the sheet stock at a right angle from the point of origin, the fifth fold being located at the section of folded sheet stock that is adjacent to the open-edge end portion of the folded sheet stock on the panel having the longer panel length. This fifth fold is equal to approximately ⅓ of the total panel length and will result in the outsert now having a resulting top panel length (L1) and a resulting adjoining bottom panel length (L2) (i.e., L1=⅓ L and L2=⅔ L). Each of the resulting adjoining bottom and top panels will now have closed ends (i.e., no edges). Following completion of this fifth fold, the sheet stock will have an overall thickness of forty plies for the resulting bottom panel length, and twenty-four plies for the resulting top panel length.

At FIG. 5B(vi), following the fifth fold, at a designated location on the resulting top panel length, a single glue spot 58 (or glue spots) is made thereon, with a suitable adhesive.

At FIG. 5B(vii), the sixth fold 59 is made to complete the improved outsert. The sixth fold is made across the entire width of the sheet stock at a right angle from the point of origin. This sixth fold is equal to approximately ½ of the total panel length and will result in the sheet stock now having a resulting top panel length (L1) and a resulting adjoining bottom panel length (L2) (i.e., L1=½ L and L2=½ L). This sixth fold is made and folded over the second end of the resulting panel length and is made in a manner whereby the adhesive will maintain the improved outsert in a more or less fixed and relationship with respect to the top and bottom panel lengths of the folded sheet stock. Following completion of this final fold, the improved outsert will have an overall thickness of approximately sixty-four plies.

If desired, the gluing step may be omitted, as the improved outsert finishes with a right-angle fold, which thereby eliminates all open edges about the periphery of the improved outsert which has a more three-dimensional physical envelope.

Additionally, in as much as the improved outsert depicted in FIG. 5B is manufactured from a single sheet of stock, the improved outsert does not require any trimming step to be performed to achieve a certain size. The final size of the improved outsert is achieved by selecting the correct respective size of initial sheet stock to be utilized.

It is noteworthy to mention that each of the outserts depicted in FIGS. 2 through 5, may be imperceptively scored at various positions intrinsic to the outsert (indicating that the outsert is folded in a particular direction along the score line), to assist in the folding of the outsert, and, accordingly, each score line are part and parcel of each outsert (but not critical, alone or in combination, to the claimed subject matter that follows).

Figure 6:
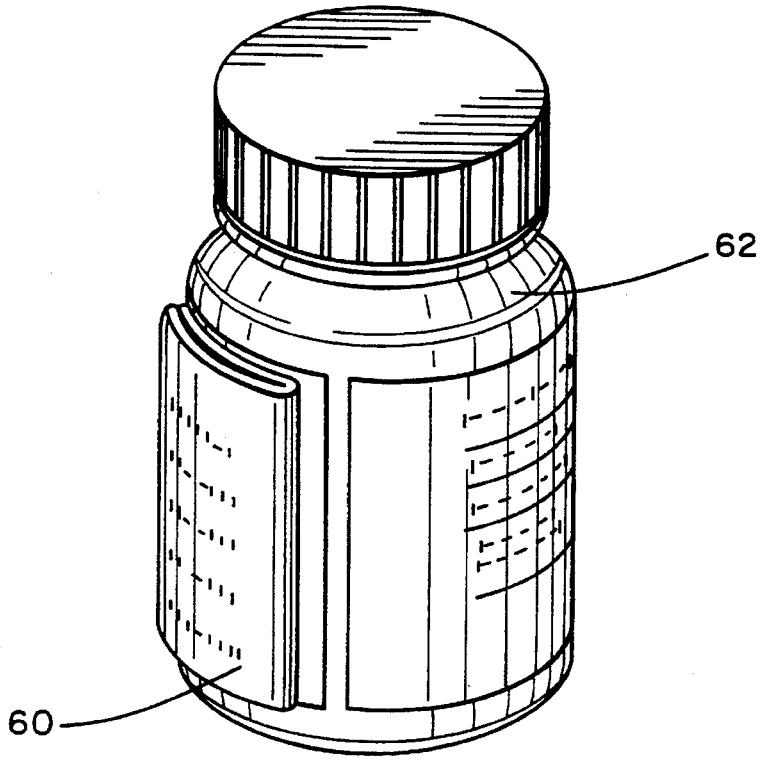

FIG. 6 is a perspective view of an outsert 60 that is constructed in accordance with the present invention suitably applied to the outside of a container 62 for a pharmaceutical product, and the like.

While the invention has been described in terms of various preferred embodiments, the person of ordinary skill in the art will appreciate that various modifications, substitutions, omissions and changes may be made without departing from the spirit thereof. Accordingly, it is intended that the scope of the present invention be limited solely by the scope of the following claims.

What is claimed is:

1. A method of folding a sheet having printed information thereon for use in the formation of an outsert for providing information to the user of a product, said method comprising the steps of:

(a) folding said sheet in half by making a first fold in the middle of said sheet to form a first folded article, said first fold being parallel to a first direction;

(b) folding said first folded article in half by making a second fold in the middle of said first folded article to form a second folded article, said second fold being parallel to a second direction, said second direction being perpendicular to said first direction, said second folded article having a first end and a second end, said first end having no open edges;

(c) folding said second folded article by making a third fold to form a third folded article, said third fold being parallel to said second direction and being made so that said second end of said second folded article is disposed between said first end of said second folded article and said third fold, said third folded article having a first sheet portion disposed between said third fold and said first end of said second folded article and a second sheet portion disposed between said third fold and said second end of said second folded article;

(d) depositing an adhesive on said second sheet portion; and (e) folding said third folded article by making a fourth fold in a direction parallel to said second direction to form a fourth folded article, said fourth fold being made so that said first sheet portion covers said second end of said second folded article so that said fourth folded article has edges which lie in a direction parallel to said second direction.

2. An outsert folded in accordance with the method defined in claim 1.

3. A method of folding a sheet having printed information thereon for use in the formation of an outsert for providing information to the user of a product, said method comprising the steps of:

(a) folding said sheet by making a first fold to form a first folded article, said first fold being parallel to a first direction;

(b) folding said first folded article by making a second fold to form a second folded article, said second fold being parallel to a second direction, said second direction being perpendicular to said first direction, said second folded article having a first end and a second end, said first end having no open edges;

(c) folding said second folded article by making a third fold to form a third folded article, said third fold being parallel to said second direction and being made so that said second end of said second folded article is disposed between said first end of said second folded article and said third fold, said third folded article having a sheet portion disposed between said third fold and said first end of said second folded article; and (d) folding said third folded article by making a fourth fold in a direction parallel to said second direction to form a fourth folded article, said fourth fold being made so that said sheet portion covers said second end of said second folded article so that said fourth folded article has edges which lie in a direction parallel to said second direction.

4. A method as defined in claim 3 wherein said step (a) comprises the step of folding said sheet in half by making said first fold in the middle of said sheet.

5. An article folded in accordance with the method defined in claim 4.

6. A method as defined in claim 3 wherein said step (b) comprises the step of folding said first article in half by making said second fold in the middle of said first folded article

7. An article folded in accordance with the method defined in claim 6.

8. A method as defined in claim 3 wherein said third folded article has a second sheet portion disposed between said third fold and said second end of second article, said method additionally comprising the step of (e) depositing an adhesive on said second sheet portion prior to said step (d).

9. An article folded in accordance with the method defined in claim 8.

10. An article folded in accordance with the method defined in claim 3.

11. A method of folding a sheet having printed information thereon for use in the formation of an outsert for providing information to the user of a product, said method comprising the steps of:

(a) folding said sheet by making a plurality of first folds to form a first folded article, said first folds being parallel to each other and parallel to a first direction, said first folds being accordion-type folds;

(b) folding said first folded article in half by making a second fold in the middle of said first folded article to form a second folded article, said second fold being parallel to a second direction, said second direction being perpendicular to said first direction, said second folded article having a first end and a second end, said first end having no open edges;

(c) folding said second folded article by making a third fold to form a third folded article, said third fold being parallel to said second direction and being made so that said second end of said second folded article is disposed between said first end of article second folded article and said third fold, said third folded said having a first sheet portion disposed between said third fold and said first end of said second folded article;

(d) folding said third folded article by making a fourth fold to form a fourth folded article, said fourth fold being parallel to said second direction and being made so that said third fold is disposed between said first end of said second folded article and said fourth fold, said fourth fold being made so that said first sheet portion of said third folded article covers said second end of said second folded article, said fourth folded article having a second sheet portion disposed between said between said fourth fold and said first end of said second folded article;

(e) depositing an adhesive on said sheet portion of said fourth folded article; and (f) folding said fourth folded article by making a fifth fold to form a fifth folded article, said fifth fold being parallel to said second direction and said fifth folded article having no open edges which lie in a direction parallel to said second direction.

12. An article folded in accordance with the method defined in claim 11.

13. A method of folding a sheet having printed information thereon for use in the formation of an outsert for providing information to the user of a product, said method comprising the steps of:

(a) folding said sheet by making at least one first fold to form a first folded article, said first fold being parallel to a first direction;

(b) folding said first folded article by making a second fold to form a second folded article, said second fold being parallel to a second direction, said second direction being perpendicular to said first direction, said second folded article having a first end and a second end, said first end having no open edges;

(c) folding said second folded article by making a third fold to form a third folded article, said third fold being parallel to said second direction and being made so that said second end of said second folded article is disposed between said first end of said second folded article and said third fold, said third folded article having a sheet portion disposed between said third fold and said first end of said second folded article;

(d) folding said third folded article by making a fourth fold to form a fourth folded article, said fourth fold being parallel to said second direction and being made so that said third fold is disposed between said first end of said second folded article and said fourth fold; and (e) folding said fourth folded article by making a fifth fold in a direction parallel to said second direction to form a fifth folded article, said fifth folded article having edges which lie in a direction parallel to said second direction.

14. A method as defined in claim 13 wherein said step (a) comprises the step of folding said sheet by making a plurality of said first folds, said first folds being parallel to each other and to said first direction.

15. An article folded in accordance with the method defined in claim 14.

16. A method as defined in claim 13 wherein said step (a) comprises the step of folding said sheet by making a plurality of said first folds, said first folds being accordion-type folds and being parallel to each other and to each direction.

17. An article folded in accordance with the method defined in claim 16.

18. A method as defined in claim 13 wherein said step (b) comprises the step of folding said first folded article in half by making said second fold in the middle of said first folded article.

19. An article folded in accordance with the method defined in claim 18.

20. A method as defined in claim 13 wherein said fourth fold in said step (d) is made so that said sheet portion of said third folded article covers said second end of said second folded article.

21. An article folded in accordance with the method defined in claim 20.

22. A method as defined in claim 13 wherein said fourth folded article has a second sheet portion disposed between said fourth fold and said first end of said second folded article, said method additionally comprising the step of (f) depositing an adhesive on said second sheet portion of said fourth folded article prior to said step (e).

23. An article folded in accordance with the method defined in claim 22.

24. An article folded in accordance with the method defined in claim 13.

25. A method of folding a sheet having printed information thereon for use in the formation of an outsert for providing information to the user of a product, said method comprising the steps of:

(a) folding said sheet by making at plurality of first folds in said sheet to form a first folded article, said first folds being parallel to a first direction and being made by folding said sheet in half to form a folded sheet and making a plurality of accordion-type folds in said folded sheet, said first folded article having a first end and a second end;

(b) folding said first folded article by making a second fold in said first folded article to form a second folded article, said second fold being parallel to a second direction, said second direction being perpendicular to said first direction, said second end of said first folded article being disposed between said first end of said first folded article and said second fold, said second folded article having a relatively large portion disposed between said first end of said first folded article and said second fold and a relatively small portion disposed between said second end of said first folded article and said second fold;

(c) folding said relatively large portion of said second folded article by making a third fold in said relatively large portion to form a third folded article, said third fold being parallel to said second direction, said first end of said first folded article being disposed between said second fold and said third fold, said third folded article having a first sheet portion disposed between said second end of said first folded article and said second fold and a second sheet portion disposed between said third fold and said first end of said first folded article;

(d) folding said third folded article by making a fourth fold to form a fourth folded article, said fourth fold being parallel to said second direction and made so that said first sheet portion covers said first end of said first folded article and so that said second fold is disposed between said third fold and said fourth fold;

(e) depositing an adhesive on said second sheet portion; and (f) folding said fourth folded article by making a fifth fold to form a fifth folded article, said fifth fold being parallel to said second direction, said fifth folded article having no open edges which lie in a direction parallel to said second direction.

26. An article folded in accordance with the method defined in claim 25.

27. A method of folding a sheet having printed information thereon for use in the formation of an outsert for providing information to the user of a product, said method comprising the steps of:

(a) folding said sheet by making at least one first fold in said sheet to form a first folded article, said first fold being parallel to a first direction, said first folded article having a first end and a second end;

(b) folding said first folded article by making a second fold in said first folded article to form a second folded article, said second fold being parallel to a second direction, said second direction being perpendicular to said first direction, said second end of said first folded article being disposed between said first end of said first folded article and said second fold, said second folded article having a relatively large portion disposed between said first end of said first folded article and said second fold and a relatively small portion disposed between said second end of said first folded article and said second fold;

(c) folding said relatively large portion of said second folded article by making a third fold in said relatively large portion to form a third folded article, said third fold being parallel to said second direction, said first end of said first folded article being disposed between said second fold and said third fold, said third folded article having a first sheet portion disposed between said second end of said first folded article and said second fold; and (d) folding said third folded article by making a fourth fold to form a fourth folded article, said fourth fold being parallel to said second direction and made so that said first sheet portion of said third folded article covers said first end of said first folded article, said fourth folded article having no open edges which lie in a direction parallel to said second direction.

28. A method as defined in claim 27 wherein said step (d) comprises the step of folding said third folded article by making said fourth fold to form said fourth folded article, said fourth fold being made so that said second fold is disposed between said third fold and said fourth fold.

29. An article folded in accordance with the method defined in claim 28.

30. A method as defined in claim 27 additionally comprising the step of (e) folding said fourth folded article by making a fifth fold in a direction parallel to said second direction to form a fifth folded article, said fifth fold being parallel to said second direction.

31. An Article folded in accordance with the method defined in claim 30.

32. A method as defined in claim 30 wherein said third folded article has a second sheet portion disposed between said third fold and said first end of said first folded article, said method additionally comprising the step of (f) depositing an adhesive on said second sheet portion prior to said step (e).

33. An article folded in accordance with the method defined in claim 32.

34. A method as defined in claim 27 wherein said step (a) comprises the step of making a plurality of folds parallel to said first direction.

35. An article folded in accordance with the method defined in claim 34.

36. A method as defined in claim 27 wherein said step (a) comprises the step of folding said sheet by making a plurality of first folds, said first folds being accordion-type folds and being parallel to each other and to said first direction.

37. An article folded in accordance with the method defined in claim 36.

38. A method as defined in claim 27 wherein said step (a) comprises the steps of:

(a1) folding said sheet in half to form a folded sheet; and (a2) making a plurality of accordion-type folds in said folded sheet to form said first folded article.

39. An article folded in accordance with the method defined in claim 38.

40. An article folded in accordance with the method defined in claim 27.

41. A method of folding a sheet having printed information thereon for use in the formation of an outsert for providing information to the user of a product, said method comprising the steps of:

(a) folding said sheet by making a first fold in said sheet to form a first folded article, said first fold being parallel to a first direction;

(b) folding said first folded article by making a second fold to form a second folded article, said second fold being parallel to said first direction;

(c) folding said second folded article by making a third fold to form a third folded article, said third fold being parallel to a second direction, said second direction being perpendicular to said first direction, said third folded article having a first end and a second end, said first end having no open edges;

(d) folding said third folded article by making a fourth fold to form a fourth folded article, said fourth fold being parallel to said second direction; and (e) folding said fourth folded article by making a fifth fold to form a fifth folded article, said fifth fold being parallel to said second direction, one of said third or fourth folded articles having a sheet portion disposed between said third and fourth folds, said folds being made so that said sheet portion covers said second end of said third folded article so that said fifth folded article has no open edges which lie in a direction parallel to said second direction.

42. An article folded in accordance with the method defined in claim 41.

43. A method of folding a sheet having printed information thereon to form an outsert for providing information to the user of a product, said outsert having a number of sheet portions, said method comprising the steps of:

(a) folding said sheet by making at least one first fold in said sheet to form a first folded article, said first fold being parallel to a first direction, said first folded article having a first end and a second end, each of said first and second ends having open edges which lie in a direction perpendicular to said first direction;

(b) folding said first folded article by taking a second fold to form a second folded article, said second fold being parallel to a second direction, said second direction being perpendicular to said first direction;

(c) folding said second folded article by making at least two additional folds in said second direction, said folds in said steps (b) and (c) being made to form said outsert in which said first end of said first folded article is covered by one of said sheet portions of said outsert in which said second end of said first folded article is covered by one of said sheet portions said outsert, and in which there are no open edges which lie in a direction parallel to said second direction.

44. An article folded in accordance with the method defined in claim 43.

* * * * *

UNITED STATES PATENT AND TRADEMARK OFFICE

CERTIFICATE OF CORRECTION

PATENT NO. : 5,458,374

DATED : October 17, 1995

INVENTOR(S) : Joseph M. Vijuk, Robert Vijuk

It is certified that error appears in the above-identified patent and that said Letters Patent is hereby corrected as shown below:

Col. 1, line 6 "if" should be --of--

Col. 2, line 66, delete the word "entire"

Col. 3, line 3, delete the word "entire"

Col. 3, line 12, delete the word "entire"

Col. 3, line 51, "eidth," should be --width--

Col. 3, line 55, delete the word "entire"

Col. 4, line 12, "folds" should be --fold--

Col. 4, line 18, insert --entire periphery, the-- after "its"

Col. 5, line 60, "thickness" should be --thickness)--

Col. 6, line 60, insert --compact-- after "more"

Col. 7, line 17, "thickness" should be --thickness)--

Col. 7, line 34, delete the word "entire"

Col. 7, line 38, delete the word "entire"

Col. 8, line 1, "an" should be --a--

Col. 9, line 50, delete "open edges"

Col. 9, line 52, "iv)" should be --(iv)--

UNITED STATES PATENT AND TRADEMARK OFFICE

CERTIFICATE OF CORRECTION

PATENT NO. : 5,458,374

DATED : October 17, 1995

INVENTOR(S) : Joseph M. Vijuk, Robert Vijuk

It is certified that error appears in the above-identified patent and that said Letters Patent is hereby corrected as shown below:

Col. 10, line 3, "open-edge" should be --open-edges--

Col. 10, line 24, "(i.e., edges)" should be --(i.e., no open edges)--

Col. 11, line 28, "54(c)" should be --54(c)]--

Col. 12, line 4, "edge" should be --edges--

Col. 12, line 12, "having edges" should be --having no open edges--

Col. 12, line 23, "(i.e., no edges)" should be --(i.e., no open edges)--

Col. 12, line 40, add --compact-- before "relationship"

Col. 12, line 47, add --compact-- before "three-dimensional"

Col. 13, line 40, "has edges" should be --has no open edges--

Col. 13, line 42, "outsert" should be --article--

Col. 14, line 4, "has edges" should be --has no open edges--

Col. 14, line 12, insert --folded-- before "article"

Col. 14, line 19, "of second article," should be --of said second folded article,--

Col. 14, line 45, "article second" should be --said second--

Col. 14, line 46, "folded said" should be --folded article--

Col. 14, line 57, "a second sheet" should be --a sheet--

UNITED STATES PATENT AND TRADEMARK OFFICE

CERTIFICATE OF CORRECTION

PATENT NO. : 5,458,374

DATED : October 17, 1995

INVENTOR(S) : Joseph M. Vijuk, Robert Vijuk

It is certified that error appears in the above-identified patent and that said Letters Patent is hereby corrected as shown below:

Col. 14, line 57, delete the words "said between"

Col. 15, line 33, "edges" should be --no open edges--

Col. 15, line 44, the second occurence of "to each" should be --to said first--

Col. 16, line 7, "at" should be --a--

Col. 17, line 34, "An Article" should be --An article--

Col. 18, line 45, "taking" should be --making--

Col. 18, line 53, "outsert in" should be --outsert, in--

Col. 18, line 55, "portions said" should be --portions of said--

Signed and Sealed this

Twelfth Day of March, 1996

Bruce Lehman

*Attest:*

BRUCE LEHMAN

*Attesting Officer*

*Commissioner of Patents and Trademarks*